US006901918B2

(12) United States Patent
Lin et al.

(10) Patent No.: US 6,901,918 B2
(45) Date of Patent: Jun. 7, 2005

(54) ENGINE CARBURETOR FREEZE-PROOF APPARATUS

(75) Inventors: Kuang Jung Lin, Kaohsiung (TW); Ching-Ming Chang, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 0 days.

(21) Appl. No.: 10/727,585

(22) Filed: Dec. 5, 2003

(65) Prior Publication Data

US 2005/0066945 A1 Mar. 31, 2005

(30) Foreign Application Priority Data

Sep. 26, 2003 (TW) ..... 92217379 U

(51) Int. Cl.[7] ..... F02M 25/06
(52) U.S. Cl. ..... 123/543; 123/572
(58) Field of Search ..... 123/572–574, 123/543–557; 261/127–144

(56) References Cited

U.S. PATENT DOCUMENTS 4,279,236 A * 7/1981 Dallman ..... 123/573
4,404,950 A * 9/1983 Dallman ..... 123/572
5,284,122 A * 2/1994 Will et al. ..... 123/549
5,699,763 A * 12/1997 Phillips et al. ..... 123/184.21

* cited by examiner

*Primary Examiner*—Marguerite McMahon
(74) *Attorney, Agent, or Firm*—Leong C. Lei

(57) ABSTRACT

An engine carburetor freeze-proof apparatus that is compact in structure to minimize its impact upon the arrangement of member parts of the vehicle and lowers production cost by providing a pipe to the engine to connect a heating joint of the carburetor, combustion blow-by from the engine enters through the heating joint into a heating passage of the carburetor to heat up the carburetor thus to prevent it from being frozen, then the blow-by being discharged through an output pipe tube from the carburetor to be reclaimed by an air filter.

4 Claims, 6 Drawing Sheets

ENGINE CARBURETOR FREEZE-PROOF APPARATUS

BACKGROUND OF THE INVENTION (a) Technical Field of the Invention

The present invention is related to an engine carburetor freeze-proof apparatus, and more particularly, to one provided with a pipe to connect the engine to the carburetor for conducting the combustion blow-by into the carburetor to prevent the carburetor from becoming iced-up in winter.

(b) Description of the Prior Art

As illustrated in FIG. 1 of the accompanying drawings, a carburetor 1 of the prior art includes an air inlet 11, a needle valve 12 and a float chamber 13. The air inlet 11 is connected through an air filter (not illustrated); one end of the needle valve 12 is connected to the air inlet 11 and another end is located in the float chamber 13; and the fuel in the float chamber 13 must retain a certain level for the carburetor 1 to conduct evaporation. When the carburetor 1 operates, the needle valve 12 is driven by a piston 14 to spray fuel, and the fresh air introduced by the air filter enters into the air inlet 11 to evaporate the fuel ejected from the needle valve 12 and the mixture is imported into the engine for explosion to produce power to push the piston in the cylinder to conduct reciprocal movements at high speed for the engine to operate.

However, during winter time or in freezing temperatures, the wall where the air inlet 11 of the carburetor 1 contacts the piston 14 is prone to icing up resulting in the failure of the needle valve 12, and further in the prevention of the return of fuel or engine stalling; consequently, the engine is prevented from operating normally. As illustrated in FIG. 2, a freeze-proof apparatus of the prior art is provided with an external hold 21 over the carburetor 2 and two pipes 31, 32 are connected to the hood 21 via a belt transmission 3. When an air filter 4 delivers fresh air to the carburetor 2 for the engine to drive the belt transmission 3, heat generated from the belt transmission 3 at high speed flows into the hood 21 of the carburetor 2 through the pipe 31 as illustrated in FIG. 3. Accordingly, the air heated in the carburetor 2 flows back through the pipe 32 into the belt transmission 3 to complete a cycle to keep the carburetor 2 from being frozen. However, the adaptation of the hood 21 not only increases the production cost but also consumes the space in the peripheral of the carburetor 2, resulting in difficulties in the arrangement of member parts of the vehicle in the design of the body and making the demand on the capacity of the engine higher.

SUMMARY OF THE INVENTION

The primary purpose of the present invention is to provide a compact freeze-proof apparatus for the carburetor of the engine that lowers the production cost and minimizes the impacts upon the arrangement of member parts of the vehicle caused by the presence of the freeze-proof apparatus. To achieve the purpose, a pipe is provided to the engine to connect an air heater joint of the carburetor to transfer the engine blow-by containing heat generated in the engine into the heating passage of the carburetor to prevent the carburetor from being frozen.

The foregoing object and summary provide only a brief introduction to the present invention. To fully appreciate these and other objects of the present invention as well as the invention itself all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
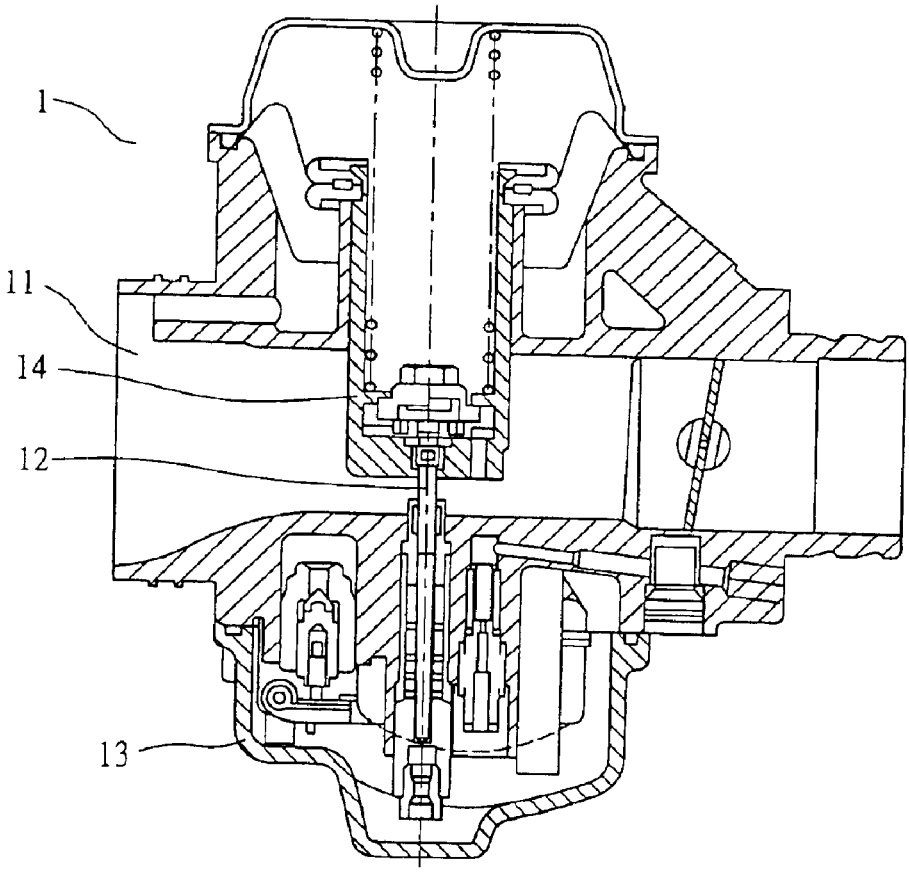
PRIOR ART FIG. 1
FIG. 1 is a schematic view showing a carburetor of the prior art.
Figure 2:
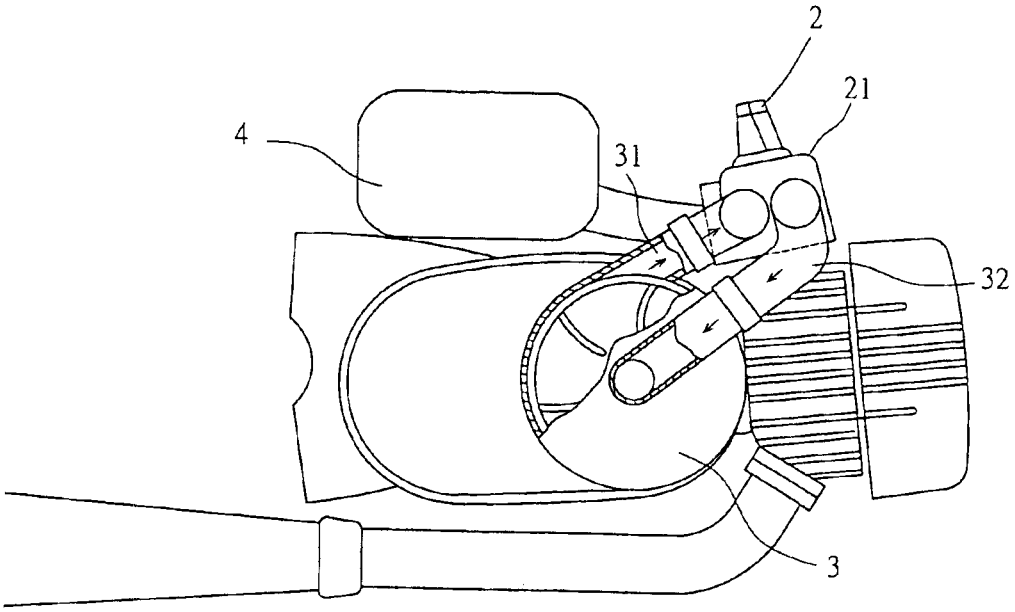
PRIOR ART FIG. 2
FIG. 2 is a schematic view of a carburetor freeze-proof apparatus of the prior art.
Figure 3:
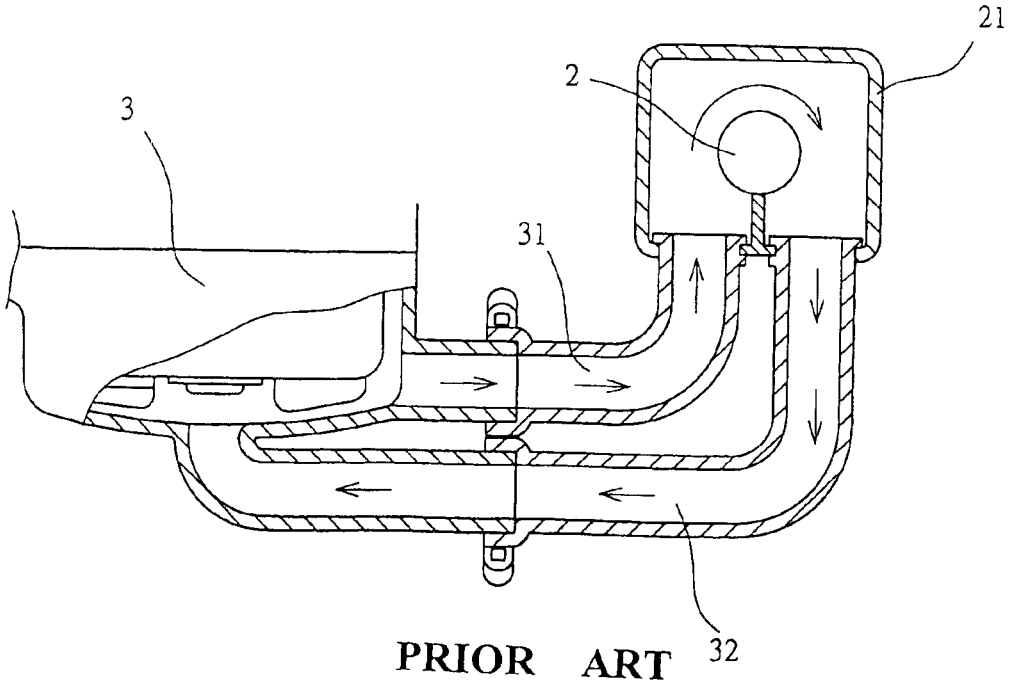
PRIOR ART FIG. 3
FIG. 3 is a schematic view showing the airflow in the carburetor freeze-proof apparatus of the prior art.
Figure 4:
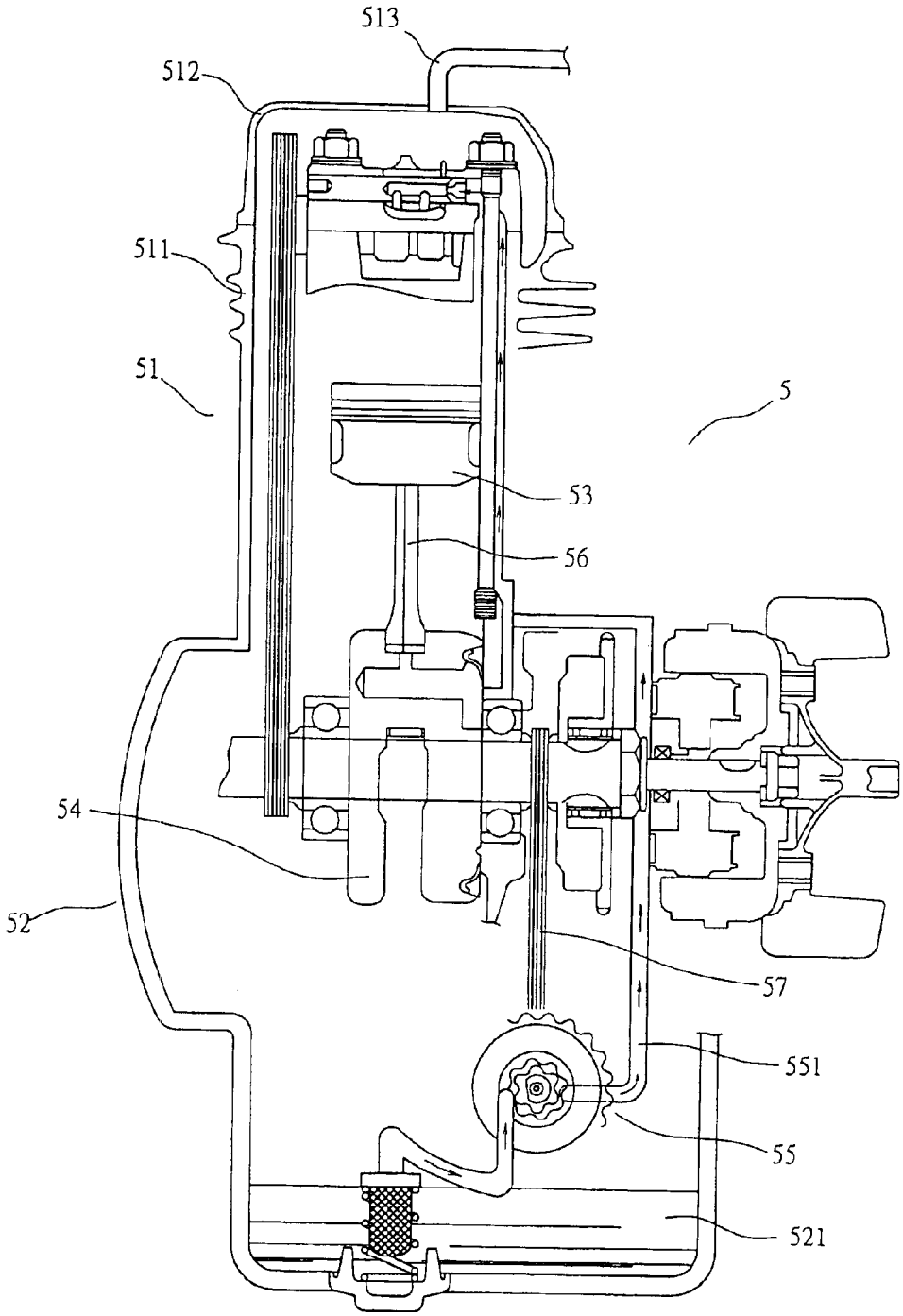
FIG. 4 is a schematic view showing an engine lubrication system of the present invention.

Referring to FIG. 4 for a lubrication system of an engine 5 of the present invention, the engine 5 is essentially comprised of a cylinder 51, a crankshaft case 52, a piston 53, a crank 54, an oil pump 55, etc. Wherein, a cylinder head 511 and a cylinder head cover 512 are provided at the top of the cylinder 51. A connecting pipe 513, generally known as a blow-by pipe, is provided to the cylinder head cover 512. The crank 54 is provided in the crankshaft case 52, and lubricant 521 is filled into the crankshaft case 52. The piston 53 is disposed in the cylinder 51 and the crankshaft 54 is connected to the piston 53 via a connecting rod 56 to convert the reciprocal movements of the piston 53 into rotation movements of the crankshaft 54. The power generated by the crankshaft 54 drives the oil pump 55 to force delivery of lubricant 521 to member parts of the engine 5. Once the engine 5 is started, fresh air is introduced to mix with the fuel. The air-fuel mixture is imported into the engine 5 for combustion to produce explosions to push the piston 53 to conduct reciprocal movements; thereby, the crankshaft conducts synchronous rotation as driven by the connecting rod 56 to further drive a chain 57 and the oil pump 55. The oil pump 55 delivers lubricant 521 through a lubrication passage 551 inside the crankshaft 52 to lubricate mechanical parts in the engine 5. The lubricant 521 then returns to the bottom of the crankshaft 52. Whereas the running engine 5 will release its internal pressure to maintain normal operation, the blow-by produced within the engine 5 is discharged out of the engine 5 via the pipe 53 connected to the cylinder head cover.

Figure 5:
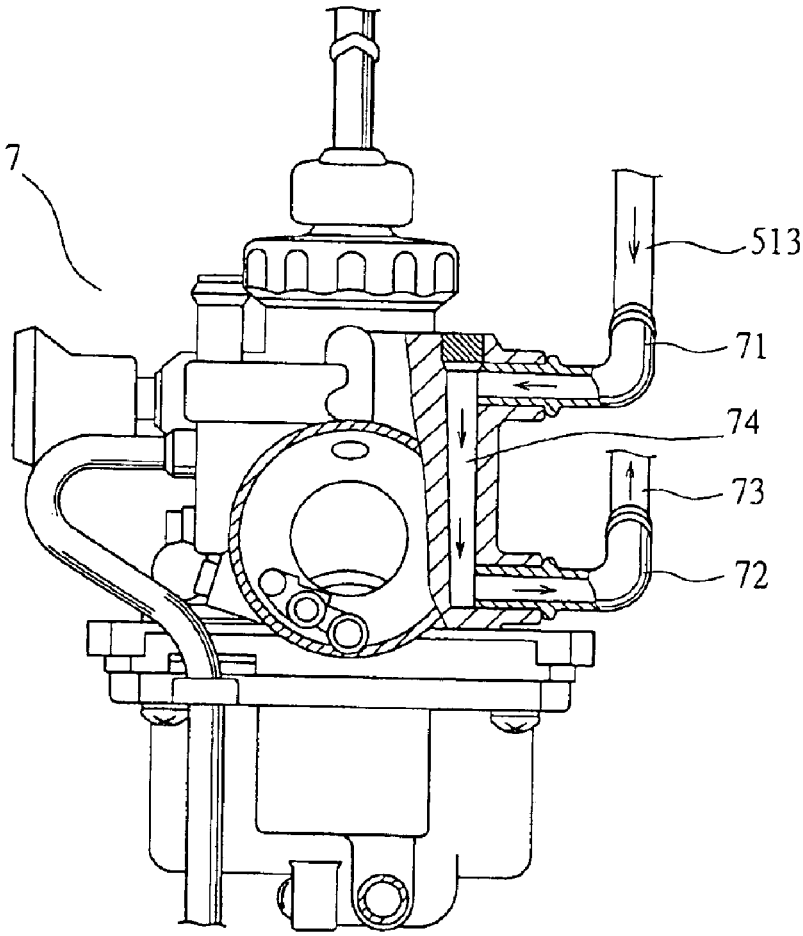
FIG. 5 is a schematic view showing a carburetor of the present invention.
Figure 6:
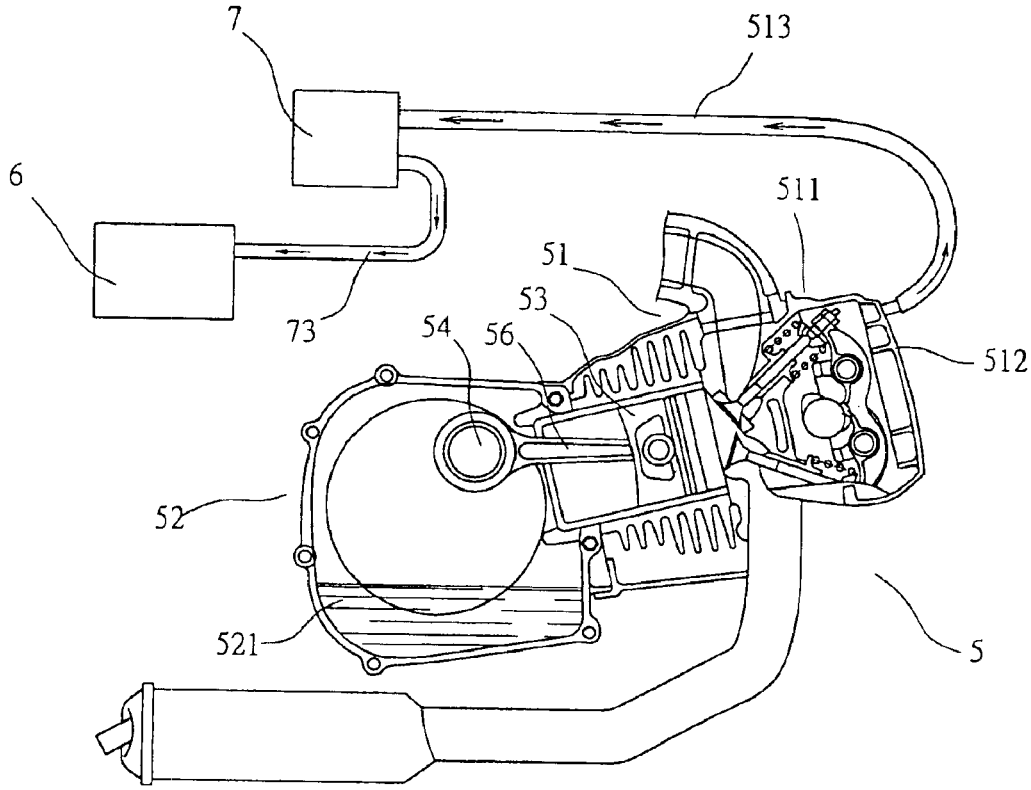
FIG. 6 is a schematic view showing a preferred embodiment of the present invention.

Now referring to FIGS. 5 and 6, a freeze-proof apparatus of the present invention delivers the blow-by to a carburetor 7 via the connecting pipe 513. An elbow joint 71 for heating and another elbow joint 72 for output are connected to the carburetor 7. The heating joint 71 connects through the connecting pipe 513 while the output joint 72 is coupled to an outlet pipe 73 and further to an air filter 6. When the engine 5 is started, the blow-by discharged from the cylinder head cover 512 is guided through the connecting pipe 513, and the heating joint 71 of the carburetor 7 and enters into a heating passage 74 inside the carburetor 7. The blow-by is then discharged through the output joint 72 of the carburetor and the output pipe 73 and reclaimed by the air filter 6 as illustrated in FIG. 6. The blow-by relates to a fuel-air mixture at high temperature and heats up the carburetor 7 once the blow-by is guided into the carburetor 7, thus to prevent the carburetor 7 from being frozen. Furthermore, the present invention can be applied in an integrated cylinder head. In such case, the connecting pipe 513 is directly connected to the cylinder head since the integrated cylinder is not provided with a cylinder head cover.

Figure 7:
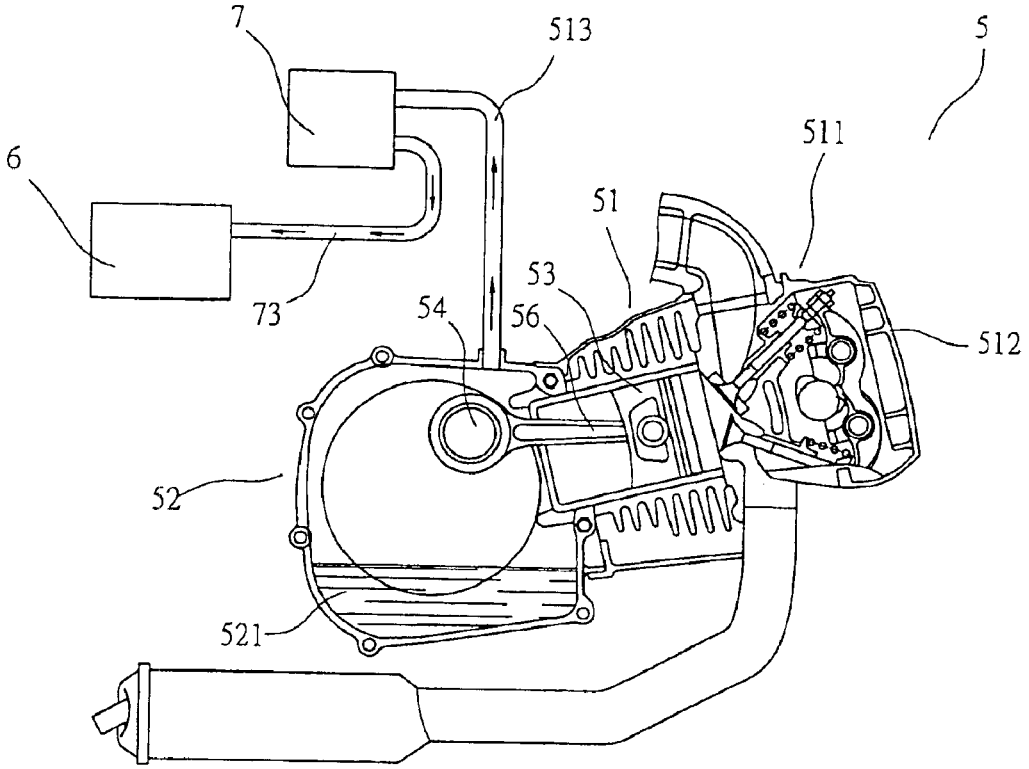
FIG. 7 is a schematic view showing another preferred embodiment of the present invention.

FIG. 7 shows another preferred embodiment of the present invention. Wherein, the connecting pipe 513 is provided to the crankshaft case 52. Similarly, the connecting pipe 513 is connected to the carburetor 7 as illustrated in FIG. 5. The heating joint 71 and the output joint 72 are also provided to the carburetor. The heating joint 71 is coupled to the pipe 513 and the output joint 72 is connected to the air filter 6 via an output pipe 73. The running engine 5 delivers the blow-by at high temperature to the heating passage 74 inside the carburetor 7 through the connecting pipe 513 and the heating joint 71 of the carburetor 7 to heat up the carburetor 7, thus keeping it from being frozen. The blow-by is then discharged through the output joint 72 and the output pipe 73 of the carburetor 7, and reclaimed by the air filter 6.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An engine carburetor freeze-proof apparatus comprising an engine having a cylinder, a cylinder head and a crankshaft, wherein blow-by is generated from the engine to release internal pressure of the engine, and a carburetor into which fresh air is introduced by an air filter, the fresh air is mixed with fuel to produce air-fuel mixture, the mixture is imported into the engine, a connecting pipe is provided to the engine and coupled to a heating joint from the carburetor, an output joint is provided to the carburetor, an output pipe is coupled to the output joint, a heating passage is provided inside the carburetor, the blow-by entering into a heating passage in the carburetor via the heating joint, the blow-by is discharged from the carburetor via the output joint and the output pipe, and the blow-by discharged from the output pipe is reclaimed by the air filter.

2. The apparatus according to claim 1, wherein, the connecting pipe is provided on the crankshaft case and coupled to the heating joint of the carburetor.

3. The apparatus according to claim 1, wherein, the connecting pipe is provided on the cylinder head and coupled to the heating joint of the carburetor.

4. The apparatus according to claim 1, wherein, the connecting pipe is provided on a cylinder head cover of the cylinder head and coupled to the heating joint of the carburetor.

* * * * *